US005794386A

United States Patent [19]

Klein

[11] Patent Number: 5,794,386

[45] Date of Patent: Aug. 18, 1998

[54] ROOF PANEL FOR SLOPED ROOFS

[75] Inventor: Udo Paul Klein, Hockenheim, Germany

[73] Assignee: Suba Cooperation Gesellschaft Fur Bauforschung und Franchising MBH, Hockenheim, Germany

[21] Appl. No.: 674,410

[22] Filed: Jul. 2, 1996

[30] Foreign Application Priority Data

Mar. 7, 1995 [DE] Germany ..... 195 23 673.4

[51] Int. Cl.[6] ..... E04B 7/02

[52] U.S. Cl. ..... 52/91.1; 52/405.3; 52/551; 52/553

[58] Field of Search ..... 52/320, 337, 405.1, 52/405.3, 551, 91.1, 376, 549, 550, 553, 602

[56] References Cited

U.S. PATENT DOCUMENTS

| | | | |
|---|---|---|---|
| 633,285 | 9/1899 | Johnson | 52/337 |
| 707,924 | 8/1902 | Hennebique | 52/337 |
| 1,547,012 | 7/1925 | Arnn | 52/602 |
| 1,796,476 | 3/1931 | Pedersen . | |
| 1,897,327 | 2/1933 | Olson | 52/602 |
| 3,435,581 | 4/1969 | Ahlqvist | 52/405.1 |
| 5,561,957 | 10/1996 | Gauthier | 52/405.3 X |
| 5,570,555 | 11/1996 | Ferguson et al. | 52/551 |

FOREIGN PATENT DOCUMENTS

| | | | |
|---|---|---|---|
| 0 392 610 A2 | 10/1990 | European Pat. Off. . | |
| 0 494 612 A1 | 7/1992 | European Pat. Off. . | |
| 600939 | 2/1926 | France . | |
| 802 183 | 2/1951 | Germany . | |
| 1 062 912 | 8/1959 | Germany . | |
| 67 50 158 | 1/1969 | Germany . | |
| 1 609 523 | 3/1970 | Germany . | |
| 24 36 515 A1 | 2/1975 | Germany . | |
| 24 05 949 A1 | 8/1975 | Germany . | |
| 40 25 639 A1 | 3/1992 | Germany . | |
| 785499 | 10/1957 | United Kingdom | 52/320 |

*Primary Examiner*—Michael Safavi
*Assistant Examiner*—Timothy B. Kang
*Attorney, Agent, or Firm*—Panitch Schwarze Jacobs & Nadel, P.C.

[57] ABSTRACT

A roof panel for sloped roofs includes a self-supporting reinforced plate of concrete-like materials, wherein the reinforcement above the plate has bars running along the slope of the roof. In the vicinity of these bars, attaching elements are arranged which bear the roofing material. In order to protect these reinforcement elements from the influence of the weather, they are embedded into concrete ribs, whereby these concrete ribs undertake the function of holding the attaching elements for the roof covering.

15 Claims, 5 Drawing Sheets

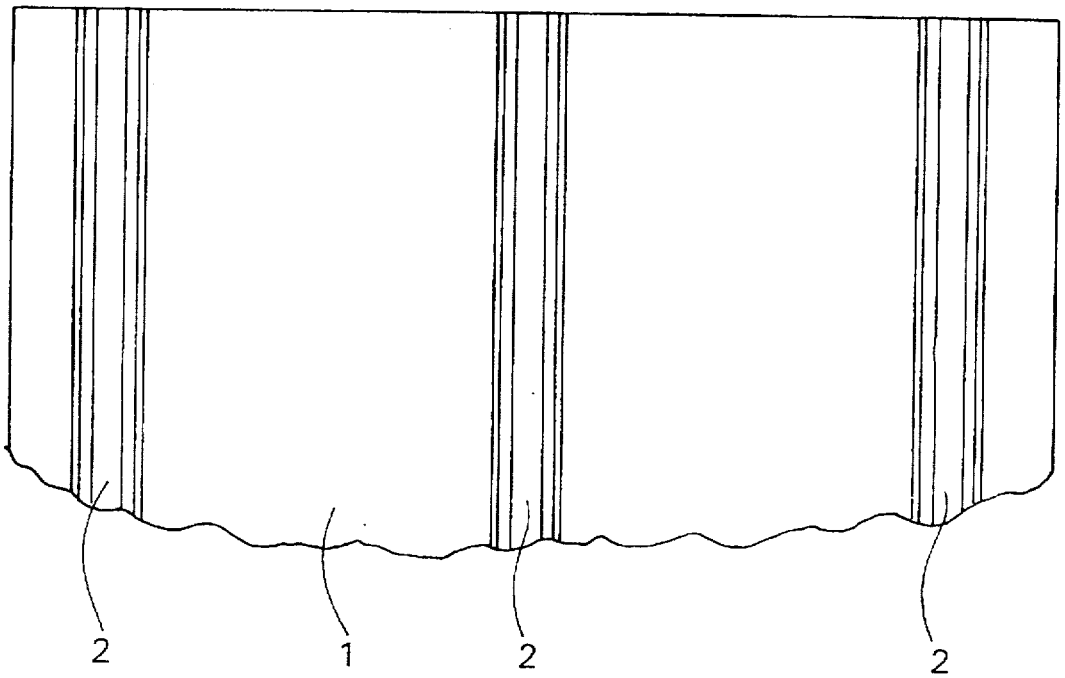
Fig. 3
Fig. 4a
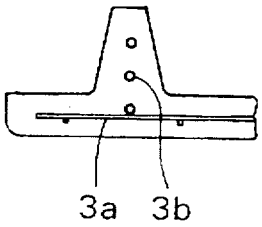
Fig. 4b
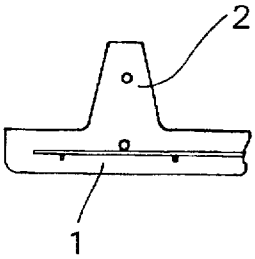
Fig. 4c
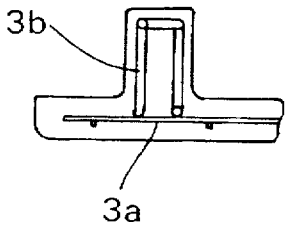

ROOF PANEL FOR SLOPED ROOFS

FIELD OF THE INVENTION

The invention concerns a roof panel for sloped roofs which consists of a self-supporting, reinforced plate of age-hardenable materials, especially concrete or concrete-like materials, wherein the reinforcement above the plate has bars running along the slope of the roof in whose vicinity attaching elements are arranged to which the roofing, especially with the interposition of transverse supports, is to be attached.

BACKGROUND OF THE INVENTION

Such a roof panel is known from EP-A 494 612. Therein, the element of reinforcement which protrudes from the plate running along the roof slope consists of stainless steel or is coated with a corrosion-preventing agent. Since these roof panels have proven themselves well in practice, underlying the present invention is the object of providing equivalent types of construction which are more flexible with regard to the use of material.

SUMMARY OF THE INVENTION

This objective is accomplished in accordance with the invention in that the roof panel has ribs of concrete or concrete-like materials running along (i.e., parallel to) the line of slope of the roof, which are joined with the plate in one piece and which contain in their interior the reinforcing bars running above the plate and encase these on all sides, and in that the ribs have attachment elements for the roofing on their upper side facing away from the plate.

From this results the advantage that the use of costly high grade steel for reinforcement can be dispensed with, and that the coating with a corrosion protective necessary with structural steel is also eliminated, since the ribs are expediently constructed just so thick that a reliable corrosion protection is assured for the reinforcement contained therein.

To be sure, ribbed concrete plates have been known for a long time. However, they function in this regard only as ceiling or wall plates, have no special alignment of the ribs to the roof slope, and accordingly do not use the ribs as carriers for a roofing.

The attachment elements for the roofing can be directly joined with the reinforcement elements running above the plate, wherein they project as far from the ribs as is necessary for assembly of the roofing, especially for the transverse supports necessary for carrying the roofing. In general, it is recommended, however, that the attachment elements be only or at least chiefly borne by the ribs. It is especially advantageous to embed the attachment elements in concrete into the ribs with the use of projecting pins, screw nails or the like. In addition, the attachment elements can also in this regard be held to the ribs by form locking, possibly by the ribs having projections or local depressions which correspond with opposing surfaces of the attachment elements. In this manner, the weight of the roofing can be directly transmitted into the roof panel, and the pins, screw nails or similar fasteners need only still absorb shearing forces, possibly owing to wind pressure.

Various possibilities exist for the constructive configuration of the attachment element. It is especially advantageous when they comprise continuous stringers which run along the roof slope. The roofer then has the possibility of attaching the roof battens at the desired grid spacing in the customary manner on the stringers.

Primarily wood, but also plastic and pressed rock wool or other substances may be considered as materials for the stringers, whereby one need only make sure that it is a poor heat conductor. For this reason, it can also be expedient that the stringers not lie with a large surface on the roof panel, but only to join it locally at several points on the rib, possibly with an interposed insulation material. The plate is moreover at any rate to be covered over large surfaces with insulation material, as is already the case with previously known roof panels. However, it is now suitable for the insulation to extend not only up to a partial height of the upward projecting reinforcement, but beyond this at least to the upper side of the ribs, and possibly even up to the height of the attachment elements.

Finally, it is recommended to install above the attachment elements an underlayer which extends over the entire roof panel and covers the attachment elements as well as the insulation placed between the ribs.

The reinforcement itself can be constructed in various manners. Generally, one will provide a grid work in the plate area, while in the ribs lattice girders, reinforcement bodies (i.e., preformed rebars) or simply continuous straight bars are used. It also lies within the scope of the invention to work with a prestressed reinforcement.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 3 is a top view of the roof panel without attachment elements, transverse supports and insulation thereon; and FIGS. 4*a*, 4*b* and 4*c* show rib cross sections for various reinforcement embodiments.

DETAILED DESCRIPTION OF PREFERRED EMBODIMENT

Figure 1:
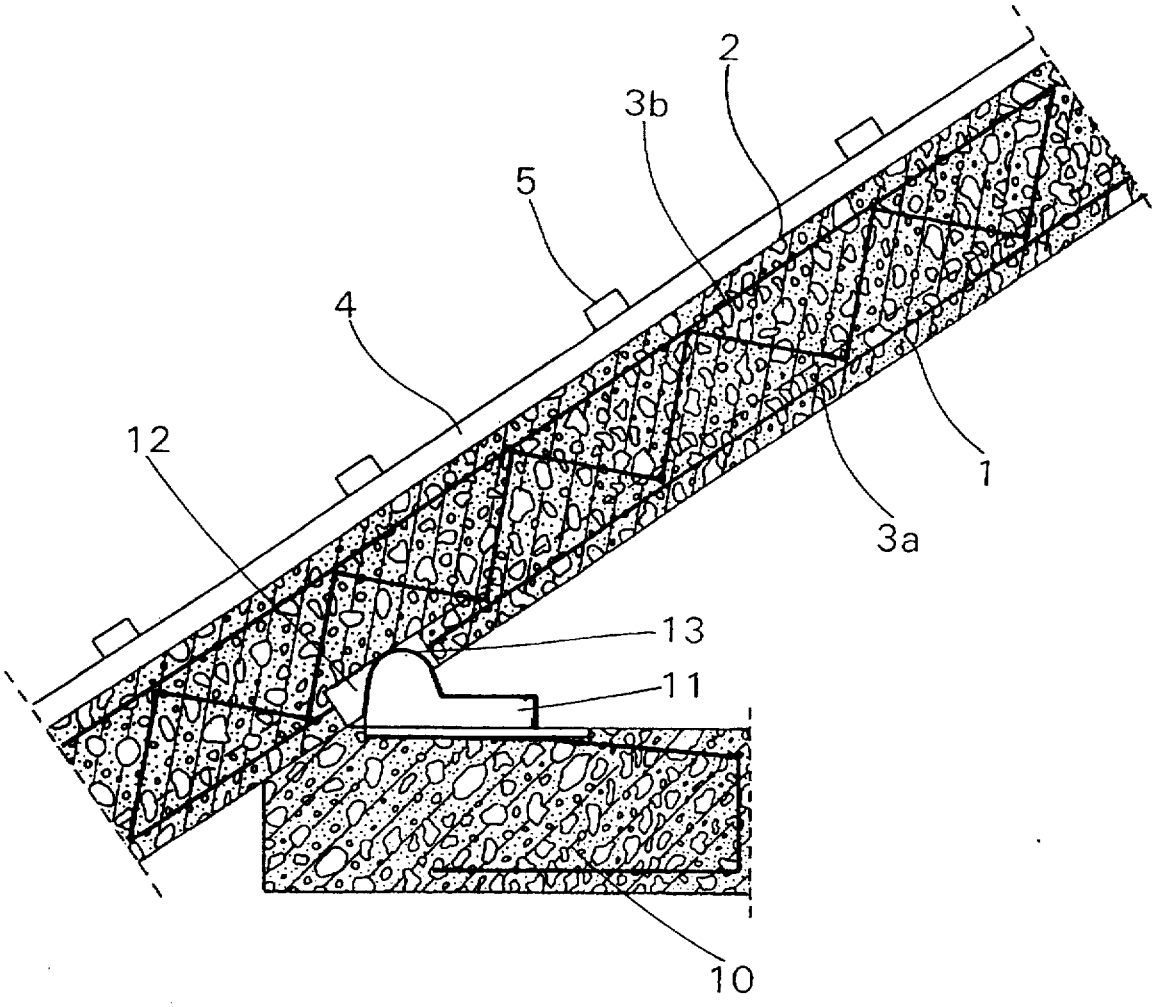
FIG. 1 is a vertical section of a roof panel according to the invention along its rib.
Figure 1A:
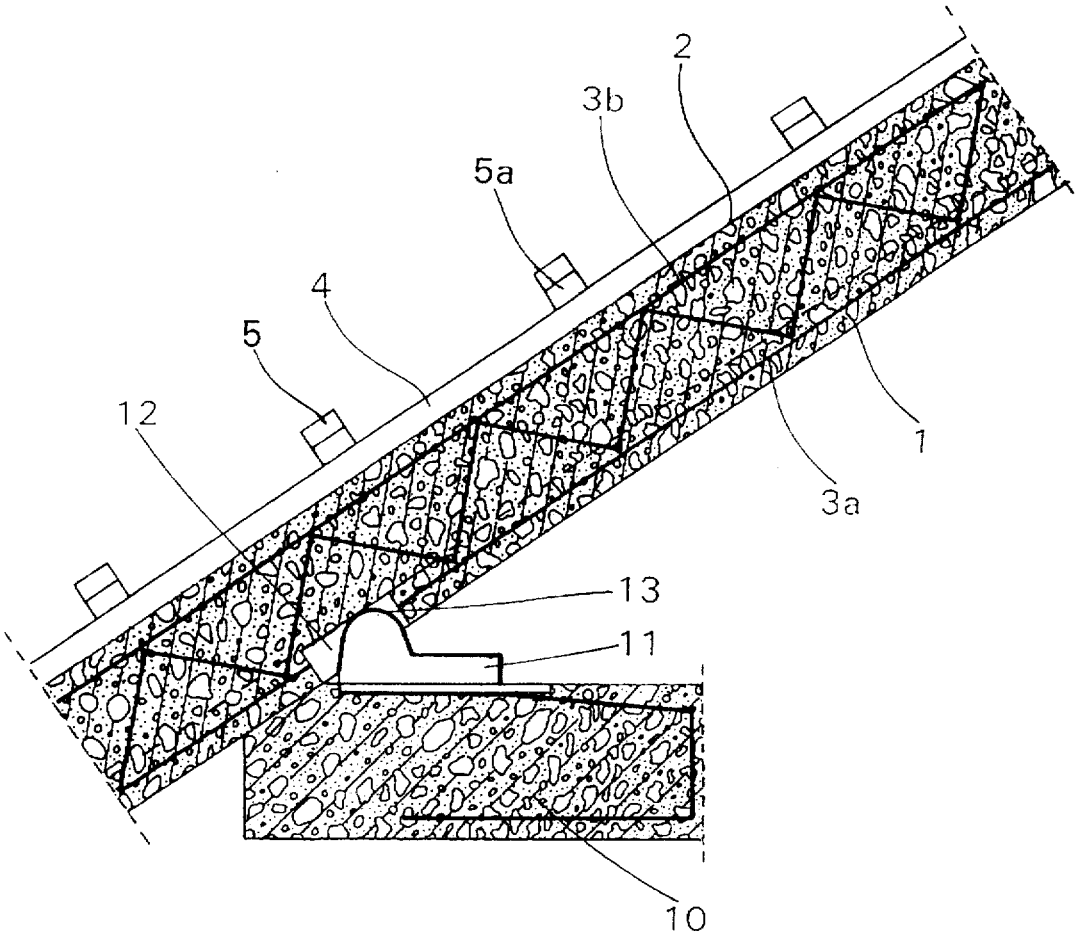
Figure 2:
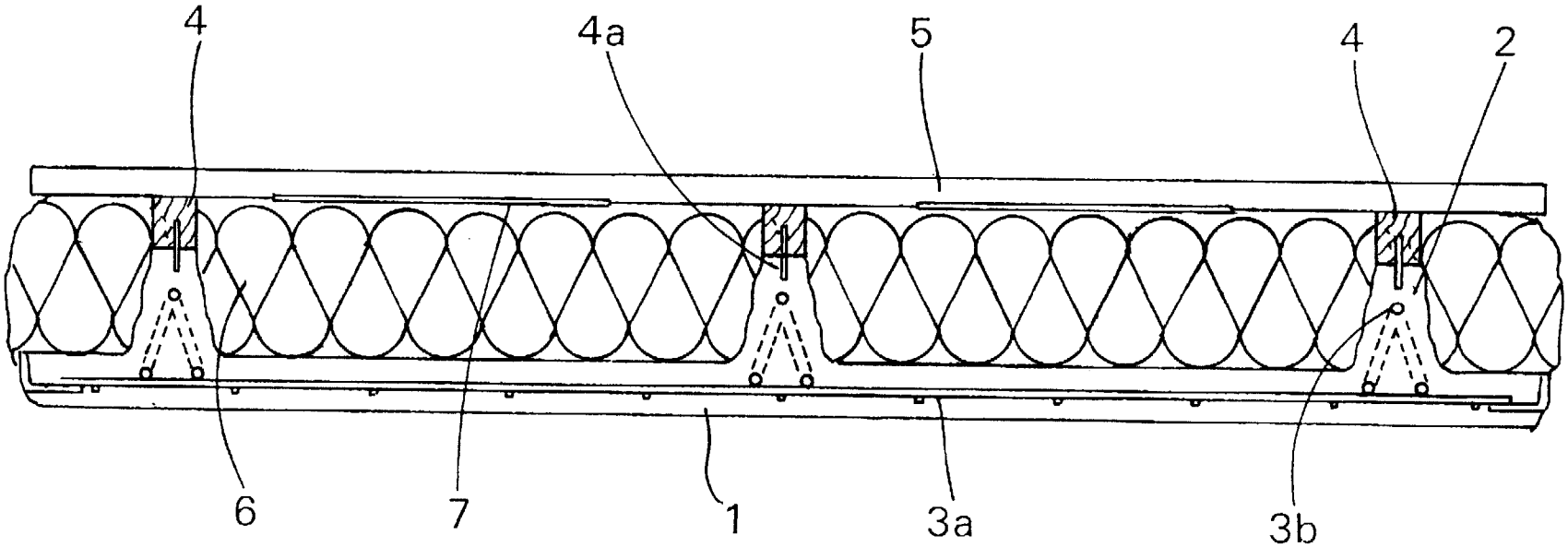
FIG. 2 is a cross section through the roof panel of FIG. 1.

In accordance with FIGS. 1, 2 and 3 the roof panel comprises a concrete plate 1 which has on its upper side several ribs 2 projecting upwardly and parallel to one another. The ribs 2 are built in concrete directly onto the plate 1 and preferably have an approximately trapezoidal cross-section, wherein they are tapered upwardly. Of course, other cross-sectional forms are also possible.

The roof plate is reinforced according to the static requirements, namely in the area of plate 1 by a reinforcement 3*a*, and in the area of the ribs 2 by a reinforcement 3*b*. The reinforcement 3*a* usually comprises a grid mat, but it must at least have some bars running transverse to the ribs 2. The reinforcement 3*b* extends largely to the height of the ribs and has lower and upper chords so that the roof panel receives sufficient bending strength. It can comprise one lattice girder or individually arranged reinforcement bars, which will be discussed later.

It is essential that attachment elements 4 be mounted on the ribs 2 and be oriented in the direction of the slope of the roof. The roofing (not depicted), mostly tiles, is suspended on these attachment elements with the interposition of transverse supports 5. The attachment elements 4 comprise longitudinal battens lying flat on the upper side of the ribs 2 and extend continuously over the entire length of the roof panel. They correspond to the usual rafters, and consequently allow the roofer to nail the transverse supports 5 in the form of typical roof laths at the desired grid spacing on the battens 4.

Figure 2A:
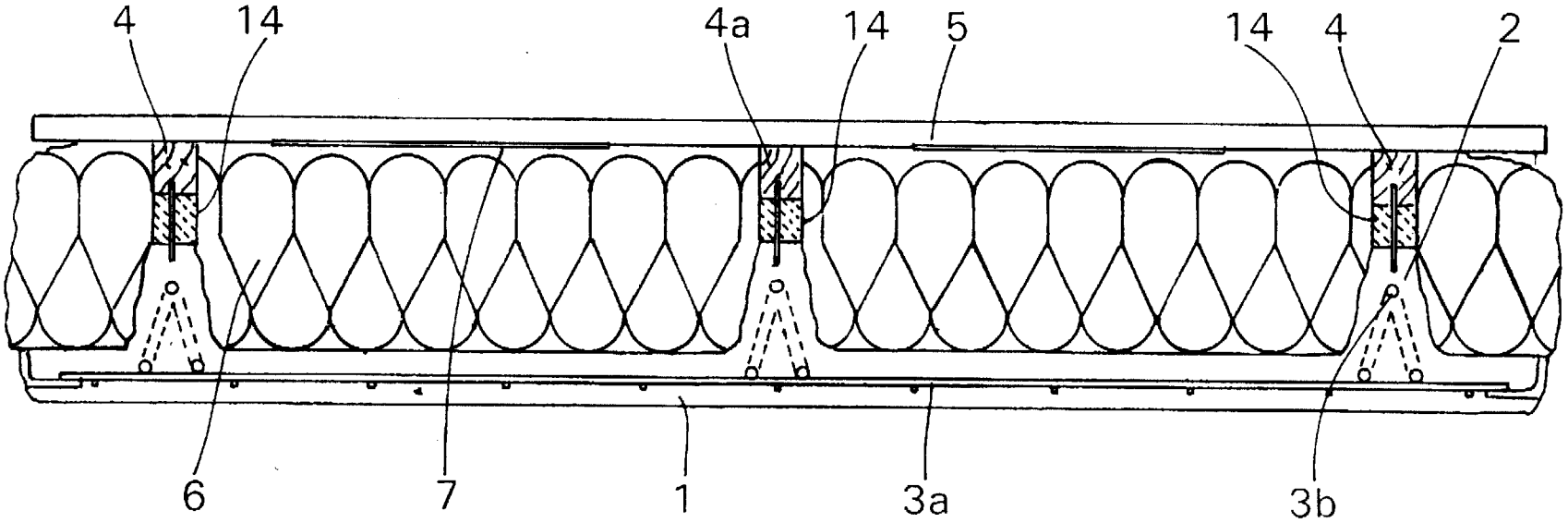
FIG. 2*a* is a cross-section similar to FIG. 2 illustrating an alternate embodiment of the invention.

The attachment elements 4 in general comprise strips of wood, and can be directly connected with the ribs 2 by projecting pins 4*a* when the roof panel is poured. It is, however, also possible to attach the attachment elements 4 through the interposition of insulation bodies 14 on the ribs 2, as shown in FIG. 2*a*.

The intermediate space between the individual ribs 2 is filled with insulation material 6. It extends almost to the upper side of the attachment elements 4.

Finally, the upper side of the roof panel is covered by an underlayer 7 which is fixed on the upper side of the ribs 2, most expediently, however, on the upper side of the attachment elements 4.

FIG. 1 depicts the mounting of the roof panel on an attic or intermediate ceiling 10. For this reason, the ceiling 10 carries a bearing shoe 11, which is embedded in concrete and/or joined with the reinforcement of the ceiling 10. It juts with its projection into a corresponding recess 12 in the plate 1 of the roof plate, and holds the latter through a metallic striking face 13 cemented into the recess 12. The striking face 13 is expediently joined with the reinforcement of the plate 1, in order to distribute the locally introduced holding force in the roof panel.

Finally, one further recognizes in FIG. 1 how the individual roof laths 5 are nailed on in the desired grid scale to the attachment elements 4, somewhat in the form of wood rafters.

FIG. 4 depicts various reinforcement possibilities for the ribs 2. If one is working with prestressed reinforcement, two or three straight continuous reinforcement bars arranged above one another, as shown in FIGS. 4*a* and 4*b*, suffice. With loose reinforcement, the usual lattice girders, approximately in accord with FIG. 2, or preformed rebars, approximately in accordance with FIG. 4*c*, are recommended.

The width of the roof panels lies preferably in the range of 2.4 m to 3 m, their length in the range of 8 m to 12 m. Reference may be made to the full details in EP-A 494 612 mentioned at the beginning for further particulars.

In summary, the advantage of the roof panel of the invention lies in the fact that corrosion protection measures are no longer necessary for the upwardly projecting reinforcement which were exposed in previously known cases, and in that the concrete ribs can be proportioned at the usual spacing of roof rafters and consequently form an ideal base for mounting the attachment elements for the roofing.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A sloped roof, comprising a roof panel having a self-supporting, reinforced plate (1) of age-hardenable material, including a reinforcement for the plate (1) comprising bars (3*b*) running generally parallel to the roof slope above the plate (1), attachment elements (4) arranged proximate to the bars (3*b*) for attaching roofing material to the panel, ribs (2) running generally parallel to the roof slope above the plate (1) and joined in one piece with the plate (1), said ribs serving to contain and enclose the bars (3*b*) on all sides, and wherein the attachment elements (4) are disposed on a side of the ribs (2) facing away from the plate (1).

2. The sloped roof according to claim 1, wherein the age-hardenable material comprises concrete or a concrete-like material.

3. The sloped roof according to claim 2, wherein the ribs (2) are made of concrete or a concrete-like material.

4. The sloped roof according to claim 1, wherein the attachment elements (4) are borne by the ribs (2).

5. The sloped roof according to claim 1, wherein the attachment elements (4) are cemented into the ribs (2) by projecting fasteners (4*a*).

6. The sloped roof according to claim 5, wherein said fasteners are selected from the group consisting of pins and screw nails.

7. The sloped roof according to claim 5, wherein the attachment elements (4) are additionally held to the ribs (2) by an interlocking connection.

8. The sloped roof according to claim 1, wherein the attachment elements comprise stringers running generally parallel to the roof slope.

9. The sloped roof according to claim 1, wherein the attachment elements (4) are made of a material which is a poor heat conductor.

10. The sloped roof according to claim 9, wherein the poor heat conducting material is selected from the group consisting of wood, plastic and rock wool.

11. The sloped roof according to claim 1, wherein the attachment elements (4) are attached to the ribs (2) through an intervening layer of insulation.

12. The sloped roof according to claim 1, further comprising insulation material (6) arranged on the plate (1) between the ribs (2), the insulation material (6) extending to a height at least to the side of the ribs (2) facing away from the plate (1).

13. The sloped roof according to claim 12, wherein the height of the insulation material extends to about a level of the attachment elements (4).

14. The sloped roof according to claim 1, wherein the attachment elements (4) include upper sides which are covered by an underlayer (7) which extends over almost the entire roof panel.

15. The sloped roof according to claim 1, wherein the reinforcement comprises prestressed reinforcing bars (3*a*, 3*b*).

* * * * *